United States Patent [19]

Kato et al.

[11] Patent Number: 4,623,605

[45] Date of Patent: Nov. 18, 1986

[54] DRY DEVELOPER FOR DEVELOPING ELECTROSTATIC LATENT IMAGES CONTAINS SILICA AND TITANIUM DIOXIDE

[75] Inventors: Hitoshi Kato, Itami; Toshitaro Kohri, Higashiosaka; Junji Machida, Itami, all of Japan

[73] Assignee: Minolta Camera Kabushiki Kaisha, Osaka, Japan

[21] Appl. No.: 683,199

[22] Filed: Dec. 18, 1984

[30] Foreign Application Priority Data

Dec. 26, 1983 [JP] Japan ..... 58-251786

[51] Int. Cl.[4] ..... G03G 9/10

[52] U.S. Cl. ..... 430/110

[58] Field of Search ..... 430/110

[56] References Cited

U.S. PATENT DOCUMENTS 3,392,139 7/1968 Dingman ..... 430/106
3,720,617 3/1973 Chatterji et al. ..... 252/62.1
3,900,588 8/1975 Fisher ..... 427/19
4,108,786 8/1978 Takayama et al. ..... 430/106.6
4,301,228 11/1981 Kori et al. ..... 430/122

FOREIGN PATENT DOCUMENTS 2635091 2/1977 Fed. Rep. of Germany ..... 430/110

*Primary Examiner*—John D. Welsh
*Attorney, Agent, or Firm*—Wenderoth, Lind & Ponack

[57] ABSTRACT

A dry developer for developing electrostatic latent images comprises a positive charge type carrier and a negative charge type toner. The negative charge type toner includes, as after-treating agents, fine particles of hydrophobic silica in an amount of 0.05–1.0 percent by weight relative to the toner and fine particles of hydrophobic titanium oxide in an amount of 0.1–3.0 percent by weight relative to the toner, the fine particles of hydrophobic silica and the fine particles of hydrophobic titanium oxide being contained in a weight ratio of 1:5 to 1:1.

2 Claims, No Drawings

DRY DEVELOPER FOR DEVELOPING ELECTROSTATIC LATENT IMAGES CONTAINS SILICA AND TITANIUM DIOXIDE

BACKGROUND OF THE INVENTION

1. Field of the Invention

The present invention relates to a dry developer for developing electrostatic latent images comprising a positive charge type carrier and a negative charge type toner.

2. Description of the Prior Art

Generally, in developing images by an electrophotographic copying machine utilizing a dry developer for developing electrostatic latent images, the development is effected either by cascading over the electrostatic latent image, the carrier particles and toner particles electrostatically attracted to each other by triboelectrical charging arising from mixing and stirring of the two particles, or by rubbing against the electrostatic image, the carrier particles and toner particles arranged in the form of a magnetic brush through magnetic force.

In the above case, although the toner particles in the developer adhere to the image-formed portions by the electrostatic force of the latent image so as to be consumed thereby, the carrier particles are repeatedly used as they are without being consumed. Thus, when the developer is used for a long period, part of the toner which does not directly contribute to the developing or the so-called "spent" toner tends to be undesirably fused over the surfaces of the carrier particles, with consequent reduction in the preformance of the carrier particles which subject the toner particles to triboelectrical charging, thus resulting in adverse effects on the image quality such as reduction in density of the developed images, generation of fogging, etc. The above developer, therefore, has the disadvantage of short life and has to be replaced with a fresh one within a short time.

In order to prevent the fusion of the "spent" toner onto the surfaces of the carrier particles and prolong the life of the developer, proposals have been made such as disclosed in U.S. Pat. Nos. 3,720,617 and 4,301,228 to add metallic oxides such as silica, alumina and the like to the toner and subject the mixture to after-treatment. It has been found, however, that with the developer utilizing a negative charge type toner such a treatment results in a rise in charging amount with repeated copying, which causes reduction in density of the developed images and adhesion of the carrier particles.

SUMMARY OF THE INVENTION

Accordingly, a primary object of the present invention is to provide an improved developer for developing electrostatic latent images, which has good fluidity and a stable charging amount in spite of repeated copying.

In order to achieve the above object, the dry developer for developing electrostatic latent images comprising a positive charge type carrier and a negative charge type toner according to the present invention is characterized in that the negative charge type toner includes, as after-treating agents, fine particles of hydrophobic silica (average particle diameter: 100 mμ or less) in an amount of 0.05–1.0 percent by weight relative to the toner and fine particles of hydrophobic titanium oxide (average particle diameter: 100 mμ or less) in an amount of 0.1–3.0 percent by weight relative to the toner, the fine particles of hydrophobic silica and the fine particles of hydrophobic titanium oxide being contained in a weight ratio of 1:5 to 1:1.

The present inventors prepared sample toners by adding to a negative charge type toner prior to addition of any after-treating agents, hereinafter referred to as toner material, varied fine particles of hydrophobic or hydrophilic silica and varied fine particles of hydrophobic or hydrophilic titanium oxide, and conducted various tests on developers comprising these sample toners and a carrier having a suitable positive charge, in an attempt to invent a developer which would achieve the object of this invention noted hereinbefore, namely a toner having good fluidity and a stable charging amount in spite of repeated copying. The results of the above tests have proved that the addition of fine particles of hydrophobic silica alone has the drawback of causing a rise in charging amount, reduction in the density of developed images and adhesion of the carrier particles with repeated copying as noted hereinbefore, that the addition of fine particles of hydrophobic titanium oxide alone has the drawback of poor toner fluidity, too low initial charging amount, and excessive dispersion of the toner, making the toner unfit for practical use, and that the addition of hydrophilic after-treating agents has the drawback of great variation in charging amount from time immediately after a treatment to time after storage. The inventors have found that the addition in a certain weight ratio of fine particles of hydrophobic silica which alone produces the undesirable results and fine particles of hydrophobic titanium oxide which alone is considered to render the toner unusable, produces excellent results by the two components effectively covering each other's defects.

More particularly, with the developer having the described composition, the reduction in the initial charging amount and in fluidity is controlled by the addition of fine particles of hydrophobic silica, and the drawback of fine particles of hydrophobic silica that the charging amount rises with repeated copying is eliminated by utilizing the property of fine particles of hydrophobic titanium oxide acting to reduce charging amount. Thus the developer has been obtained which, on the whole, has excellent fluidity and a stable charging amount in spite of repeated copying.

According to the present invention, particularly good results are obtained where the fine particles of hydrophobic silica and fine particles of hydrophobic titanium oxide have average particle diameters 7 to 50 mμ and 20 to 100 mμ, respectively.

DETAILED DESCRIPTION OF THE INVENTION

Description will particularly be made hereinafter of contents of the various tests conducted in order to obtain the developer according to the present invention, namely the dry developer for developing electrostatic latent images comprising a positive charge type carrier and a negative charge type toner, wherein the negative charge type toner includes, as after-treating agents, fine particles of hydrophobic silica (average particle diameter: 100 mμ or less) in an amount of 0.05–1.0 percent by weight relative to the toner and fine particles of hydrophobic titanium oxide (average particle diameter: 100 mμ or less) in an amount of 0.1–3.0 percent by weight relative to the toner, the fine particles of hydrophobic silica and the fine particles of hydrophobic titanium oxide being contained in a weight ratio of 1:5 to 1:1. A description will also be given of how the desired developer is obtained through comparative studies on the results of these tests, and of effects thereby produced.

For the negative charge type toner or toner material, those are selected which include a thermoplastic resin binder comprising, for example, styrene-acrylic copolymer resin, polyester resin, methacrylic resin, varied derivatives thereof or a mixture thereof, and a coloring material dispersed in the binder. The toner material may also include, as necessary, a charge controlling agent such as chromium complexed solvent dye, and an offset preventing agent.

First, the following two kinds of toner material are prepared:

Toner Material A containing the following components:

(a) 100 weight parts of thermoplastic polyester resin, molecular weight Mn: about 6100, Mw: about 202500;

(b) 4 weight parts of carbon black "MA100" (manufactured by Mitsubishi Chemical Industries, Ltd., Japan);

(c) 3 weight parts of "SPIRON BLACK TOH" as charge controlling agent (manufactured by Hodogaya Chemicals Co., Ltd., Japan); and (d) 5 weight parts of low molecular weight polypropylene "VISCOL 550P" as offset preventing agent (manufactured by Sanyo Chemical Industries, Ltd., Japan).

The above materials were sufficiently mixed in a Henshell mixer, and were then kneaded by a twin-screw extruder/kneader. The resulting product was allowed to cool, and was thereafter crushed to coarse particles and then further crushed and classified by a jet mill and a classificator to finally obtain a toner material having particle diameters ranging from 4 to 20 μm and an average particle diameter of 11.5 μm.

Toner Material B containing the following components:

(a') 100 weight parts of thermoplastic styrene-acrylic acid ester resin, molecular weight Mn: about 9500, Mw: about 21500;

(b) 4 weight parts of carbon black "MA100" manufactured by Mitsubishi Chemical Industries, Ltd., Japan);

(c) 3 weight parts of "SPIRON BLACK TOH" as charge controlling agent (manufactured by Hodogaya Chemical Co., Ltd., Japan); and (d) 5 weight parts of low molecular weight polypropylene "VISCOL 550P" as offset preventing agent (manufactured by Sanyo Chemical Industries, Ltd., Japan).

The above materials were treated in the same manner as were the components of Toner Material A to obtain a toner material having particle diameters ranging from 4 to 20 μm and an average particle diameter of 11.5 μm.

Next, hydrophobic silica, hydrophobic titanium oxide, hydrophilic silica and hydrophilic titanium oxide as shown in Table 1 were prepared for addition as after-treating agents. These after-treating agents were added solely or in pairs and in a predetermined amount to Toner Materials A and B, respectively. Resulting sample toners Nos. 1–22 are shown in Table 2.

TABLE 1

| No. | After-treating agent | Average particle diameter | Brandname or abbreviation |
|---|---|---|---|
| 1 | Hydrophobic silica | 16 mμ | AEROSIL "R972" (manufactured by Aerosil Nippon Co., Ltd., Japan) |
| 2 | Hydrophobic silica | 7 mμ | AEROSIL "R976" (manufactured by Degussa) |
| 3 | Hydrophobic titanium oxide | 30 mμ | AEROSIL "T805" (manufactured by Degussa) |
| 4 | Hydrophilic titanium oxide | 30 mμ | AEROSIL "P-25" (manufactured by Degussa) |
| 5 | Hydrophilic silica | 12 mμ | AEROSIL "200" (manufactured by Aerosil Nippon Co., Ltd.) |
| 6 | Hydrophobic titanium oxide | 20 mμ | "Titanium B", which is titanium oxide (manufactured by Imperial Chemical Industries, Ltd., Japan) turned hydrophobic by dimethyl-chlorsilane |
| 7 | Hydrophobic titanium oxide | 30 mμ | "Titanium C", which is hydrophilic titanium oxide AEROSIL P-25 turned hydrophobic by an aluminum type coupling agent AL-M (manufactured by Ajinomoto Co., Ltd., Japan) |
| 8 | Hydrophobic titanium oxide | 500 mμ | "Titanium D", which is the same as Titanium B but has a greater average particle diameter |
| 9 | Hydrophobic silica | 500 mμ | "Silica B", which is hydrophilic silica FPS-1 (manufactured by Shionogi Pharmaceutical Co., Ltd., Japan) turned hydrophobic by dimethyl-chlorosilane |
| 10 | Hydrophobic silica | 12 mμ | "Silica C", which is hydrophilic silica AEROSIL 200 turned hydrophobic by aluminum type coupling agent AL-M. |
| 11 | Hydrophobic silica | 50 mμ | "Silica D", which is hydrophilic silica AEROSIL RX-50 (manufactured by Aerosil Nippon Co., Ltd.) turned hydrophobic by dimethyl-chlorsilane. |
| 12 | Hydrophobic titanium oxide | 100 mμ | "Titanium E", which is the same as Titanium B but has a greater average particle diameter |
| 13 | Hydrophobic titanium oxide | 150 mμ | "Titanium F", which is the same as Titanium B but has a greater average particle diameter |

TABLE 2

| Sample No. | Toner Material | After-treating agent −1 (amount added - wt %) | After-treating agent −2 (amount added - wt %) | Note |
|---|---|---|---|---|
| 1 | A | R972(0.3%) | | Silica only |
| 2 | A | R976 (0.15%) | | Silica only (small particle diameter; added in small amount) |
| 3 | A | T805(0.4%) | | Titanium only |
| 4 | A | R972(0.2%) | T805(0.3%) | Silica and titanium |
| 5 | A | R976 (0.05%) | T805(0.1%) | Silica and titanium |
| 6 | A | R976 (0.03%) | T805 (0.07%) | Silica and titanium (added in small amount) |
| 7 | A | R972(1.0%) | T805(3.0%) | Silica and titanium |
| 8 | A | R972(1.5%) | T805(3.5%) | Silica and |

TABLE 2-continued

| Sample No. | Toner Material | After-treating agent −1 (amount added - wt %) | After-treating agent −2 (amount added - wt %) | Note |
|---|---|---|---|---|
| | | | | titanium (added in large amount) |
| 9 | A | R976(0.2%) | T805 (0.15%) | Silica and titanium (with titanium added in small amount) |
| 10 | A | R972(0.1%) | T805(0.6%) | Silica and titanium (with titanium added in large amount) |
| 11 | A | R972(0.2%) | P-25(0.4%) | Silica and titanium (hydrophilic titanium) |
| 12 | A | 200(0.2%) | T805(0.4%) | Silica and titanium (hydrophilic silica) |
| 13 | A | R976(0.1%) | Titanium B (0.3%) | Silica and titanium |
| 14 | A | R976(0.1%) | Titanium D (0.5%) | Silica and titanium (titanium having large particle diameters) |
| 15 | A | Silica B (0.3%) | T805(0.4%) | Silica and titanium (silica having large particle diameters) |
| 16 | A | R976(0.1%) | Titanium C (0.3%) | Silica and titanium (treated with aluminum type coupling agent) |
| 17 | A | Silica C (0.15%) | Titanium C (0.3%) | Silica and titanium (treated with aluminum type coupling agent) |
| 18 | A | Silica C (0.15%) | T805(0.3%) | Silica and titanium (treated with aluminum type coupling agent) |
| 19 | B | R976(0.1%) | T805(0.3%) | Silica and titanium |
| 20 | A | Silica D (0.3%) | T805(0.3%) | Silica and titanium |
| 21 | A | R976(0.1%) | Titanium E (0.5%) | Silica and titanium |
| 22 | A | R972(0.2%) | Titanium F (0.3%) | Silica and titanium (titanium having large particle diameters) |

How the positive charge type carrier was prepared will be described next.

The carrier contains the following components:

(a″) 100 weight parts of styrene-acrylic copolymer resin "PLIOLITE ACL" (manufactured by Goodyear International Corp.);

(b′) 5 weight parts of carbon black "MA100" (manufactured by Mitsubishi Chemical Industries, Ltd.); and (e) 200 weight parts of magnetic powder "MAPICO BLACK BL-500" (manufactured by Titanium Industries, Ltd., Japan).

The above components were mixed in a ball mill, kneaded in a three-roll mill, and then crushed into fine particles by a pin mill. The fine particles were thereafter classified by a classificator to finally obtain the positive charge type carrier having an average particle diameter of 40 μm.

10 weight parts of this positive charge type carrier were mixed within a short time with 90 weight parts of each of sample toners Nos. 1 to 22 shown in Table 2 which were the negative charge type toners treated with the after-treating agents as already described. The resulting developers were filled into a magnetic brush developing apparatus, and toner dispersion occurring during operation of the apparatus was determined.

Copying tests were also carried out on each of the developers prepared in the same manner as above, by using a copying machine employing a positve charge type Se(selenium) photoreceptor and a teflon-coated heat roller fixing device. In the tests the electric charging amount of toners was measured after developing an electrostatic latent image on 30,000 sheets of copying paper by magnetic brush development. Furthermore, the image density at the beginning of the copying tests and the image density after processing the 30,000 sheets of copying paper were measured by means of a reflecting density meter.

In the above copying machine, the electric potential of an image formed portion (Vo) was +600 V, the electric potential of a non-image formed portion (ViR) was +50 to 100 V, and the development bias potential (Vb) was +150 V.

Table 3 shows results of the tests conducted on each toner sample, the results being shown in repect of initial charging amount of toner, toner dispersion, charging amount after long-term copying tests, initial image density and image density after long-term copying tests.

In the column of toner dispersion in Table 3, a minimal amount of dispersion is marked , a small amount of dispersion is marked O, a large amount of dispersion unfit for practical use is marked X, and an extremely large amount of dispersion is marked XX. In the column of synthetic judgment, a good result is marked O, and a bad result is marked X, with the reasons for a bad result being briefly noted therein.

TABLE 3

| | | | Copying test | | | |
|---|---|---|---|---|---|---|
| | | | | Image Density | | |
| Sample No. | Initial charging amount of toner | Toner dispersion | Toner charging amount after long term test | Initial | After long-term test | Synthetic judgment |
| 1 | −12 μc/g | | −15 μc/g | 1.3 | 1.0 | X great increase in charging amount, and great reduction in image density |
| 2 | −11 | O | −15 | 1.4 | 1.1 | X great increase in charging amount, and great reduction in image density |
| 3 | −5 | XX | | | | X insufficient initial charging amount |
| 4 | −10 | O | −11 | 1.4 | 1.3 | O |
| 5 | −10 | O | −11 | 1.4 | 1.3 | O |

TABLE 3-continued

| Sample No. | Initial charging amount of toner | Toner dis-persion | Copying test: Toner charging amount after long term test | Copying test: Image Density: Initial | Copying test: Image Density: After long-term test | Synthetic judgment |
|---|---|---|---|---|---|---|
| 6 | −9 | X | −14 | 1.4 | 1.4 | X great increase in charging amount |
| 7 | −9 | O | −12 | 1.4 | 1.3 | O |
| 8 | −8 | X | −11 | 1.4 | 1.4 | X uneven charging of toner |
| 9 | −10 | O | −14 | 1.3 | 1.1 | X great increase in charging amount, and great reduction in image density |
| 10 | −6 | XX | | | | X insufficient initial charging amount |
| 11 | −11 → (−5)* | O → XX | | | | X attenuation of charging amount with toner storage |
| 12 | −11 → (−7)* | O → X | | | | X attenuation of charging amount with toner storage |
| 13 | −10 | O | −11 | 1.4 | 1.4 | O |
| 14 | −12 | O | −15 | 1.3 | 1.0 | X great increase in charging amount, and great reduction in image density |
| 15 | −6 | X | | | | X insufficient initial charging amount |
| 16 | −10 | O | −12 | 1.3 | 1.25 | O |
| 17 | −9 | O | −11 | 1.4 | 1.3 | O |
| 18 | −10 | O | −11 | 1.3 | 1.3 | O |
| 19 | −10 | O | −11 | 1.3 | 1.3 | O |
| 20 | −11 | O | −12 | 1.3 | 1.4 | O |
| 21 | −10 | O | −10 | 1.4 | 1.3 | O |
| 22 | −10 | | −15 | 1.3 | 1.0 | X great increase in charging amount, and great reduction in image density |

*With samples Nos. 11 and 12 it has been confirmed that the charging amount of the toner rapidly attenuates to the values in parentheses.

The following facts are clear from the above results:

(i) Addition of ordinary hydrophobic silica alone results in a great increase in charging amount and great reduction in image density during the copying test (Samples Nos. 1 and 2).

(ii) Addition of hydrophobic titanium oxide alone renders the initial charging amount insufficient and results in notable toner dispersion (Sample No. 3).

(iii) Addition of hydrophobic silica and hydrophobic titanium oxide together, with increased absolute amounts of silica and titanium oxide, renders the charging amount of toner uneven and causes a large amount of toner dispersion (Sample No. 8).

(iv) Addition of the above two agents in excessively small absolute amounts does not allow titanium oxide to produce its effect, whereby the charging amount increases to an extreme degree and a large amount of toner dispersion occurs too (Sample No. 6).

(v) Addition of the above two agents, with silica added in a greater amount than titanium oxide, permits only silica to play its properties to the full, whereby the charging amount increases to an extreme degree (Sample No. 9).

(vi) Addition of the above two agents, with titanium oxide added in a greater amount than silica, renders the initial charging amount insufficient (Sample No. 10).

(vii) Addition of the above two agents where both are hydrophilic causes the charging amount to attenuate rapidly (Samples Nos. 11 and 12).

(viii) Addition of the above two agents, with titanium oxide having large particle diameters, permits silica to exert great influence whereby the charging amount increases to an extreme degree (Samples Nos. 14 and 22).

(ix) Addition of the above two agents, with silica having large particle diameters, renders the initial charging amoung insufficient (Sample No. 15).

(x) Toner samples Nos. 4, 5, 7, 13, and 16–21, which constitute embodiments of the present invention, have been confirmed effective to produce high quality images over the entire copying test.

Furthermore, the amount of the hydrophobic silica fine particles was varied while mixing the hydrophobic silica fine particles and hydrophobic titanium fine particles in a weight ratio of 1:5 to 1:1. When the hydrophobic silica fine particles were added in an amount less than 0.05 percent by weight, the fluidity tended to decrease. Conversely, when the hydrophobic silica fine particles were added in an amount exceeding 1.0 percent by weight, the charging amount tended to increase with repeated copying. Thus it is clear from these tests that good results are obtained by adding the hydrophobic silica fine particles in an amount, as absolute amount, ranging from 0.05 to 1.0 percent by weight. When the hydrophobic titanium oxide fine particles were added in an excessive amount, there were problems of causing flaws on photoreceptor surfaces, unstable mixing with the toner, and insufficient initial charging amount of the toner. It has been clear that good results are obtained by adding the hydrophobic titanium oxide fine particles in an amount, as absolute amount, ranging from 0.1 to 3.0 percent by weight.

On the other hand, the average particle diameters of the hydrophobic silica fine particles and the hydrphobic titanium oxide fine particles were varied respectively. When the average particle diameters exceeded 100 mμ, mixing with the toner as well as the fluidity was unsatisfactory even if the two agents were added in the above ranges of amount. It has been clear that good results are obtained when the two agents have an average particle diameter not exceeding 100 mμ.

It has been proved that particularly good results are obtained when the hydrophobic silica fine particles have an average particle diameter ranging from 7 to 50 mμ and the hydrophobic titanium oxide fine particles have an average particle diameter ranging from 20 to 100 mμ.

What is claimed is:

1. A dry developer for developing electrostatic latent images comprising (A) a positive charge type carrier comprising fine particles of a mixture of a styrene-acrylic copolymer, carbon black and a magnetic powder, and (B) a negative charge type toner comprising a thermoplastic polymer selected from the group consisting of a polyester and a styrene-acrylic acid ester, and a charge controlling agent, wherein the negative charge type toner includes, as after-treating agents, fine particles of hydrophobic silica, having an average particle diameter of 100 mμ or less, in an amount of 0.05–1.0 percent by weight relative to the toner, and fine particles of hydrophobic $TiO_2$, having an average particle diameter of 100 mμ or less, in an amount of 0.1–3.0 percent by weight relative to the toner, the weight ratio of the fine particles of hydrophobic silica to the fine particles of hydrophobic $TiO_2$ being 1:5 to 1:1.

2. A dry developer according to claim 1 wherein the fine particles of hydrophobic silica have an average particle diameter ranging from 7 to 50 mμ and the fine particles of hydrophobic $TiO_2$ have an average particle diameter ranging from 20 to 100 mμ.

* * * * *